US009149105B2

(12) United States Patent
Yoe

(10) Patent No.: US 9,149,105 B2
(45) Date of Patent: Oct. 6, 2015

(54) HAIR DRIER

(76) Inventor: Han Hian Yoe, Shenzhen (CN)

( * ) Notice: Subject to any disclaimer, the term of this patent is extended or adjusted under 35 U.S.C. 154(b) by 203 days.

(21) Appl. No.: 13/996,927

(22) PCT Filed: Jul. 20, 2012

(86) PCT No.: PCT/CN2012/078985

§ 371 (c)(1),
(2), (4) Date: Jun. 21, 2013

(87) PCT Pub. No.: WO2013/037247

PCT Pub. Date: Mar. 21, 2013

(65) Prior Publication Data

US 2013/0263464 A1 Oct. 10, 2013

(30) Foreign Application Priority Data

Sep. 16, 2011 (CN) ..... 2011 2 0349155 U

(51) Int. Cl.
*A45D 20/50* (2006.01)
*A45D 20/10* (2006.01)
*A45D 20/12* (2006.01)

(52) U.S. Cl.
CPC ..... *A45D 20/10* (2013.01); *A45D 20/12* (2013.01)

(58) Field of Classification Search
CPC ..... F26B 3/00; F26B 5/00; F26B 11/00; F26B 21/00; A45D 20/00; A45D 20/50
USPC ..... 34/95, 96, 97, 99, 100; 392/384, 385; 132/271
See application file for complete search history.

(56) References Cited

U.S. PATENT DOCUMENTS

| | | | | | |
|---|---|---|---|---|---|
| 1,607,195 | A * | 11/1926 | Gross | 392/379 |
| 3,846,047 | A * | 11/1974 | Wada et al. | 417/234 |
| 3,986,272 | A * | 10/1976 | Feierabent | 34/97 |
| 4,197,448 | A * | 4/1980 | Harigai | 392/384 |
| 4,904,847 | A * | 2/1990 | Kosaka et al. | 392/384 |
| 4,977,306 | A * | 12/1990 | Kosaka et al. | 392/380 |
| 5,884,008 | A * | 3/1999 | Goldberg | 392/385 |
| D434,182 | S * | 11/2000 | Cheung | D28/16 |
| 6,317,998 | B1 * | 11/2001 | Benevelli | 34/97 |
| D472,015 | S * | 3/2003 | Young | D28/13 |
| 8,302,324 | B1 * | 11/2012 | Connelly | 34/97 |
| 8,707,577 | B2 * | 4/2014 | Lee et al. | 34/97 |
| 2012/0124854 | A1 * | 5/2012 | Lee et al. | 34/97 |
| 2013/0008043 | A1 * | 1/2013 | Correll et al. | 34/97 |
| 2013/0263464 | A1 * | 10/2013 | Yoe | 34/97 |
| 2014/0298670 | A1 * | 10/2014 | Tahara et al. | 34/97 |

* cited by examiner

*Primary Examiner* — Stephen M Gravini
(74) *Attorney, Agent, or Firm* — Novoclaims Patent Services LLC; Mei Lin Wong

(57) ABSTRACT

A hair dryer comprises a housing (1), a fan assembly, a heating element, and a handle (2). The fan assembly and the heating element are located in the housing (1). The handle (2) and the housing (1) are in rotational connection. An upper portion of the handle (2) is U-shaped. A rotating shaft is located at the end of the U-shaped upper portion. The U-shaped upper portion is provided with a hair brush at a position corresponding to the air inlet of the housing (1). The housing (1) can swing left and right on the handle (2). When the housing (1) is swung, the hair brush can clean the dust at the air inlet of the housing (1), making the hair dryer both simple and sanitary.

2 Claims, 2 Drawing Sheets

HAIR DRIER

BACKGROUND OF THE PRESENT INVENTION

1. Field of Invention

The present invention relates to a hair dryer, and more particularly to a hair dryer which is convenient to use, and is capable of brushing dust around an air inlet of the hair dryer.

2. Description of Related Arts

Hair dryers are necessary appliances in daily lives. A conventional hair dryer usually comprises a housing, a fan motor, and a heating element. The housing usually has a tubular main portion having an air outlet, an air inlet providing on the housing at a position opposite to the air outlet, and a filter mounted at the air inlet. The fan motor is rotationally mounted in the tubular main portion at a position near the air inlet. The fan motor is connected to a plurality of fan blades so that when the fan motor is rotated, the fan blades are adapted for initiating air suction and blowing within the tubular main portion of the housing, so that air is sucked into the tubular main portion via the air inlet, and is blown out of the tubular main portion via the air outlet. The heating element is provided near the air outlet, and is electrically connected to an operation switch on the housing. The operation switch is arranged to control an operation of the heating element and the fan motor so as to control the temperature of the air blowing out of the air outlet, and the speed of the air flow. For such a conventional hair dryer just described, the air outlet is covered with a lot of dusts which can only be removed manually by using brushes. As a result, there is a need to develop a hair dryer which can remove dust at the air outlet.

SUMMARY OF THE PRESENT INVENTION

An objective of the present invention is to provide a hair dryer which is convenient to use, and is capable of brushing dust around an air inlet of the hair dryer.

The above object of the present invention is accomplished by the following preferred embodiment of the present invention.

In one aspect of the present invention, it provides a hair dryer comprising a housing, a fan assembly, a heating element and a handle, wherein the handle is provided on the housing in such a manner that the handle is rotationally connected to the housing.

The housing has an upper side, an bottom side, and two holes forming on the upper side and the bottom side respectively, wherein the handle has an upper portion, and two rotating shafts providing on two end portions of the upper portion respectively, wherein the two rotating shafts are rotationally connected to the two holes of the housing respectively.

The upper portion of the handle has a U-shaped cross section. The two rotating shafts are provided on two end portions of the upper portion of the handle respectively.

The hair dryer further comprises a brush mounting on the upper portion of the handle and at a position aligning with an air inlet of the housing.

The hair dryer of the present invention has the following advantages as compared to conventional art:

The handle and the housing of the hair dryer are rotationally connected to each other so that the housing may swing left or right with respect to the handle. As a result the hair dryer of the present invention is very convenient to use. Moreover, a brush is connected to the handle at a position aligning with an air inlet of the housing. When the housing swings with respect to the handle, the brush may brush the area around the air inlet of the housing so as to remove any dust covering on the area around the air inlet. This configuration allows the user to conveniently remove the dust covering on the housing around the air inlet so as to maintain optimal hygiene on the part of the hair dryer.

DETAILED DESCRIPTION OF THE PREFERRED EMBODIMENT

The following detailed description of the preferred embodiment is the preferred mode of carrying out the invention. The description is not to be taken in any limiting sense. It is presented for the purpose of illustrating the general principles of the present invention.

Figure 1:
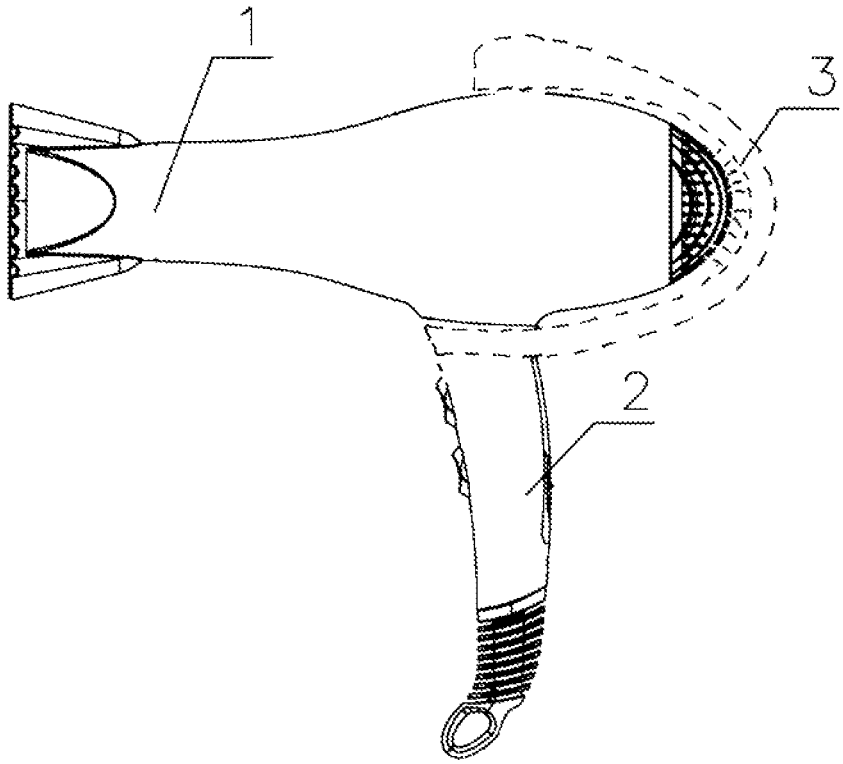
FIG. 1 is a schematic diagram of a hair dryer according to a preferred embodiment of the present invention.
Figure 2:
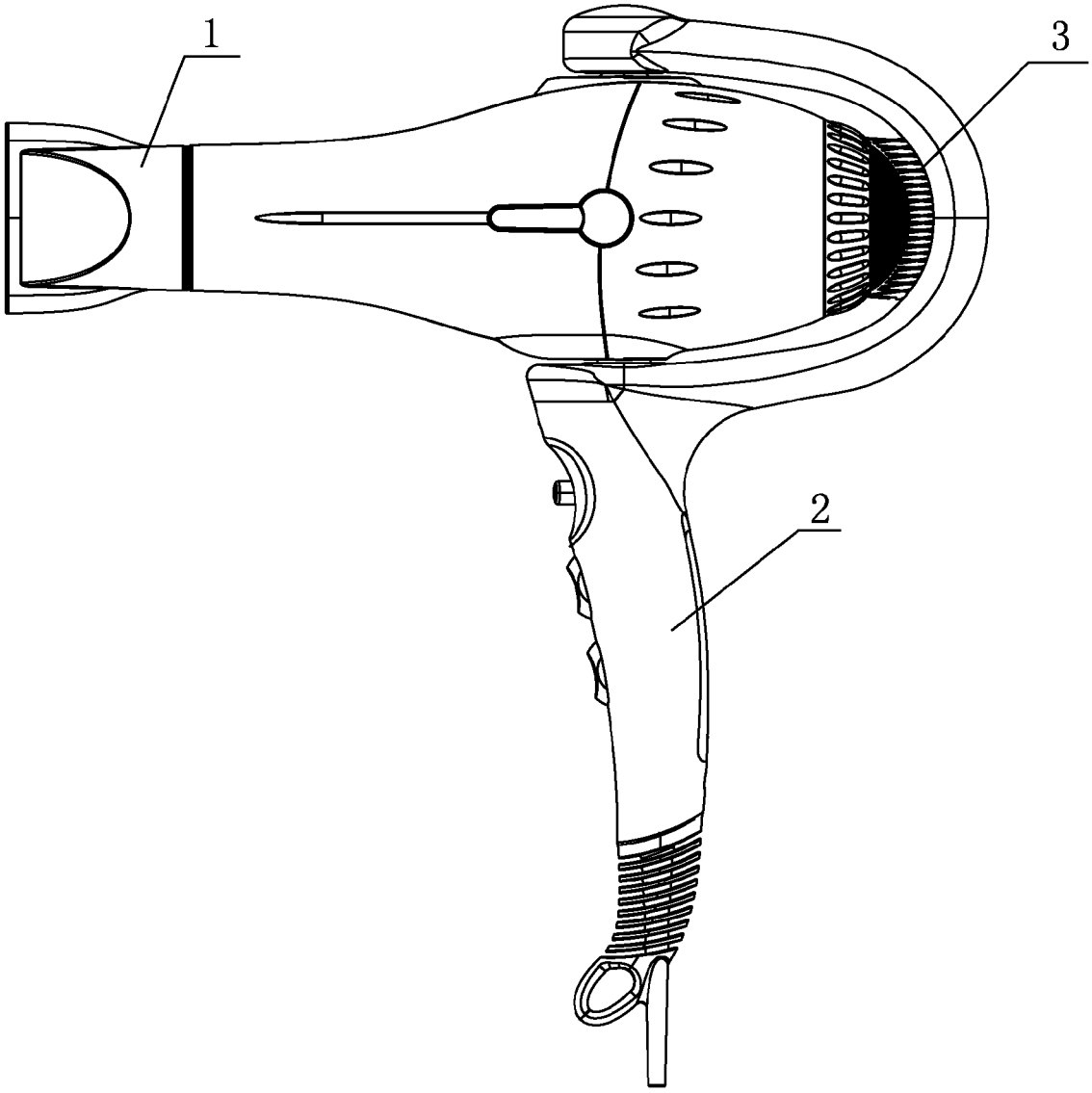
FIG. 2 is a side view of the hair dryer according to the preferred embodiment of the present invention.

Referring to FIG. 1 to FIG. 2 of the drawings, a hair dryer according to a preferred embodiment of the present invention is illustrated. The hair dryer comprises a housing 1, a fan assembly, a heating element, and a handle 2 rotationally provided on the housing 1 so that the handle 2 may rotate with respect to the housing 1. The fan assembly and the heating element are provided in the housing 1. The housing 1 has two holes formed on an upper side and a bottom side respectively. The handle 2 has an upper portion which has a U-shaped cross section. In addition, the handle 2 has two rotating shafts provided on two end portions of the U-shaped upper portion of the handle 2, and are positioned to align with the holes of the housing 1 respectively. The rotating shafts are configured to be inserted into the holes of the housing 1 respectively so that the housing 1 may rotate with respect to the handle 2 via the rotating shafts. The hair dryer further comprises a brush 3 mounted on the upper portion of the handle 2 and is positioned to align with an air inlet of the housing 1. The handle 2 is rotationally connected to the housing 1 in such a manner that the housing 1 can reciprocatingly swing with respect to the handle 2. Since the handle 2 is connected to the brush 3, when the housing 1 swings with respect to the handle 2, the brush 3 is arranged to brush the area around the air inlet of the housing 1 so as to remove any dust covering on the area around the air inlet. This configuration allows the user to conveniently remove the dust covering on the housing 1 around the air inlet so as to maintain optimal hygiene on the part of the hair dryer.

What is claimed is:

1. A hair dryer comprising:

a housing, said housing having an upper side, an bottom side, and two holes forming on said upper side and said bottom side respectively;

a fan assembly;

a heating element; and a handle having an upper portion, and two rotating shafts providing on two end portions of said upper portion respectively and extending toward said upper side and said bottom side of said housing respectively, said two rotating shafts being rotationally connected to said two holes of said housing respectively, wherein said handle being provided on said housing in such a manner that said handle is rotationally connected to said housing, such that said housing is arranged to pivotally swing about a longitudinal axis of said handle.

2. The hair dryer, as recited in claim 1, wherein said upper portion of said handle has a U-shaped cross section, said two rotating shafts being provided on two end portions of said upper portion of said handle respectively, said hair dryer further comprising a brush mounting on said upper portion of said handle and at a position aligning with an air inlet of said housing.

* * * * *